United States Patent [19]

Saito et al.

[11] Patent Number: 4,970,533

[45] Date of Patent: Nov. 13, 1990

[54] INK JET PRINTER USING EXCHANGEABLE INK CASSETTE, AND RECORDING HEAD AND INK CASSETTE THEREFOR

[75] Inventors: Takashi Saito; Shigeru Yoshimura, both of Yokohama; Hiroshi Nitanda, Tokyo; Junichi Asano, Kawasaki, all of Japan

[73] Assignee: Canon Kabushiki Kaisha, Tokyo, Japan

[21] Appl. No.: 429,557

[22] Filed: Oct. 31, 1989

[30] Foreign Application Priority Data

Oct. 31, 1988 [JP] Japan ..... 63-273082

[51] Int. Cl.[5] ..... B41J 2/175

[52] U.S. Cl. ..... 346/140 R

[58] Field of Search ..... 346/140

[56] References Cited

U.S. PATENT DOCUMENTS 4,419,678 12/1983 Kasugayama ..... 346/140

*Primary Examiner*—Joseph W. Hartary
*Assistant Examiner*—Alrick Bobb
*Attorney, Agent, or Firm*—Fitzpatrick, Cella, Harper & Scinto

[57] ABSTRACT

The present invention provides an ink jet printer wherein a service life of an ink jet recording head can be effectively utilized by exchanging ink cassettes to be mounted on the recording head. The printer comprises a first supporting mechanism for removably supporting the ink jet recording head, a second supporting mechanism for removably supporting the ink cassette accommodating ink to be supplied to the ink jet recording head, and a recording device provided in the printer or in the ink jet recording head mounted on the printer, for recording or storing the number of the ink cassettes applied to the ink jet recording head mounted on the printer. The present invention also provides an ink jet recording head and an ink cassette used with the above-mentioned ink jet printer.

24 Claims, 9 Drawing Sheets

INK JET PRINTER USING EXCHANGEABLE INK CASSETTE, AND RECORDING HEAD AND INK CASSETTE THEREFOR

BACKGROUND OF THE INVENTION

1. Field of the Invention

The present invention relates to an ink jet printer having an ink jet recording head and an ink cartridge for supplying ink to the ink jet recording head. More particularly, the present invention relates to an ink jet printer wherein, among the ink jet recording head and ink cartridge, at least the ink cartridge is exchangeable, and to a recording head removable with respect to the ink jet printer for exchange, and further to an ink cartridge (refer to also as "ink cassette" hereinafter) removable with respect to the recording head. Further, the present invention relates to an ink jet recording unit for sale, having a specific construction.

2. Related Background Art

Recently, in order to record information on a recording medium such as a paper, various techniques have been proposed. Among them, there is an ink jet recording system. In the ink jet recording system, ink is supplied to a recording head from an ink cartridge accommodating the ink therein, and then the ink is discharged from ink drop jet nozzles formed in the recording head on the recording medium (such as a paper) as ink drops created by means of electrical-mechanical converting elements or more preferably electrical-thermal converting elements, thereby recording an image on the recording head. Accordingly, the ink jet recording system has advantages that (a) a sharp image can be recorded on a recording paper regardless of the roughness of the surface of the recording paper, since the recording head does not directly contact the recording paper, and (b) not only a monocolor image but also a full color image can be obtained, since the image information is recorded as the combination of (ink) dots.

In such an ink jet recording system, various ink supplying methods have been proposed. Particularly, an ink supplying method using an exchangeable ink cartridge has a meritorious advantage that the running cost of the recording operation can be considerably reduced by using the ink cartridge having large capacity.

In the ink jet printer using the exchangeable ink cartridge, when the ink in one ink cartridge is used up, by replacing the empty cartridge by a new spare ink cartridge, the expensive recording head can be used for a long time regardless of the capacity or volume of the ink cartridge, with the result that the running cost can be reduced.

The structure for mounting and dismounting the ink cartridge with respect to the recording head is disclosed, for example, in the U.S. Pat. No. 4,306,245. Further, the U.S. Pat. No. 4,771,295 discloses an ink jet printer wherein an ink accommodating portion is formed integrally with a recording head portion and, when ink in the ink accommodating portion is used up (which can be detected by imperfect or erroneous recording of an image), the recording head portion together with the ink accommodating portion is exchanged into a new recording head portion. The recording head portion disclosed in this U.S. Pat. No. is actually removed from the printer and dumped or disposed, when the ink in the ink accommodating portion formed integrally with the recording head portion is used up, nevertheless the recording head portion can be still used if the empty ink accommodating portion is replenished with the ink. Accordingly, such recording portions have in effect been disposed wastefully.

SUMMARY OF THE INVENTION

The present invention aims to make the whole printer and/or the ink cartridge compact or small-sized, to eliminate the wastefulness of the recording head, and to obtain the optimum efficiency of ussage of the recording head, in consideration of a unique point, i.e., the service life of the recording head, which has not yet been taken into consideration.

An object of the present invention is to provide an ink jet printer and an ink jet recording head which are simple and compact, and have good operability, and have no complicated operations or manipulations for judging poor or erroneous printing due to the combination of an improper ink cartridge to a recording head and other causes, by clarifying the proper usable range of the recording head corresponding to the service life of the recording head.

Another object of the present invention is to provide an ink jet printer which can solve a problem that, while the same single recording head is continuously used by exchanging ink cartridges whenever the ink in each ink cartridge is used up, when the recording head goes wrong, if the recording head still continues to be used, the poor printing occurs, and which can alert an operator it is time to exchange of the recording head, thereby preventing the occurrence of the poor printing due to the wrong recording head.

A further object of the present invention is to provide an ink jet printer including an ink jet recording head portion and an exchangeable ink cartridge for supplying ink to the ink jet recording head portion and further including means for storing the number of the used ink cartridges.

A still further object of the present invention is to a judging mechanism, preferably an automatic judging mechanism (not judged by an operator), wherein only a predetermined number of ink cartridges (for example, 2–5 in case of a non-returnable recording head, and 10–30 (relatively large ink cartridges) in case of a recording head usable for a long time) are availably set in accordance with the service life of the recording head, thereby permitting the judgement of the correct timing of the exchange of the recording head.

According to a preferred aspect of the present invention, there is provided an ink jet printer comprising a first supporting mechanism for removably supporting an ink jet recording head, a second supporting mechanism for removably supporting an ink cassette accommodating ink to be supplied to the ink jet recording head, and recording means provided in the printer or in the ink jet recording head mounted on the printer, for recording or storing the number of the ink cassettes applied to the ink jet recording head mounted on the printer.

In another aspect of the present invention, there is provided an ink jet printer further comprising a residual amount detection means for detecting the fact that a residual amount of the ink in the ink cassette is reduced below or equal to a predetermined amount, and means for indicating the necessity of the exchange of the recording head when the residual amount detection means detects the fact that the ink in a last ink cassette is reduced below or equal to the predetermined amount, the last ink cassette corresponding to a last one among a predetermined number of the ink cassettes recorded by the recording means.

A further object of the present invention is to provide an ink jet printer which permits an auxiliary recording by effectively utilizing unstable or uncertain residual service life of a normal ink jet recording head determined by factor of safety of construction after one ink cartridge in correspondence with the service life of the normal recording head has been used, and which comprises means for removably supporting the ink jet recording head, an ink cassette holding portion for removably supporting either a normal recording ink cassette accommodating ink to be supplied to the ink jet recording head or an auxiliary recording ink cassette accommodating ink of an amount less than that of the ink accommodated into the normal recording ink cassette, and means for displaying a recording condition performed by auxiliary recording ink when the auxiliary recording ink cassette is mounted on the ink cassette holding portion. Here, "auxiliary recording" means that, if the erroneous or poor recording occurs during the recording operation in this mode (auxiliary recording mode), the service life of the recording head is terminated, and, thus, that an operator may exchange the recording head with a new one without doubt when the poor recording occurs.

A still further object of the present invention is to provide a unit for sale, wherein the number of used or applied ink cassettes is stored or recorded in a recording head and which includes the recording head and a number of ink cassettes corresponding to a residual service life of the recording head.

The other objects of the present invention will be apparent from the following description and the contents of claims.

PREFERRED EMBODIMENT OF THE INVENTION

Hereinafter, the present invention will be explained with reference to drawings.

Figure 6:
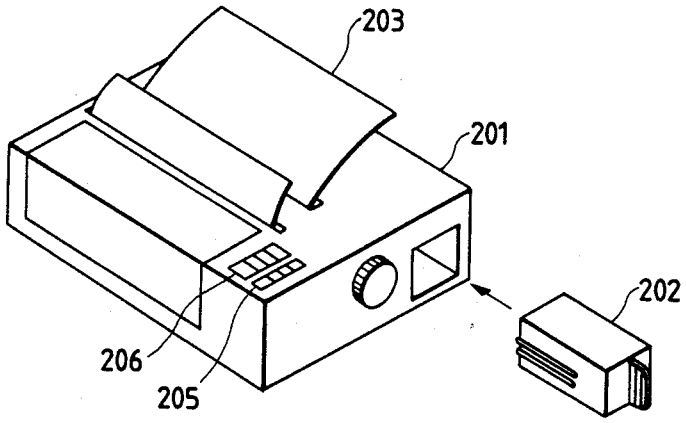
FIGS. 6 and 7 are perspective views of a printer having an exchangeable ink cartridge to which the present invention can be applied.
Figure 7:
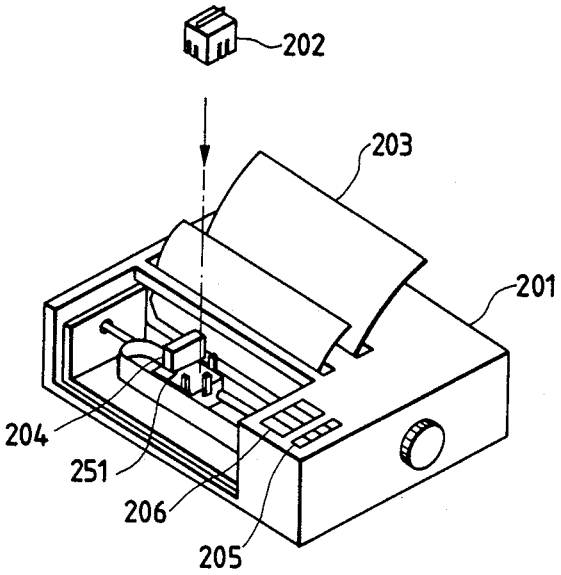

FIGS. 6 and 7 respectively show different types of ink jet printer to which the present invention is applied.

In FIG. 6, the printer includes an ink jet recording body 201, and an ink cartridge 202 exchangeable relative to the body 201. The cartridge 202 supplies ink to the recording head through a flexible ink supply tube (not shown). Numeral 203 designates a material to be recorded, 205 designates a switch for mode change of the recording apparatus, sheet feeding and on-line, 206 is a display displaying state or condition of the recording apparatus. When the ink cartridge 202 becomes empty, it can be exchanged with new one.

FIG. 7 shows another type ink jet printer, in which an ink cartridge 202 in mounted to a carriage of a serial printer, and the ink is supplied to an ink liquid jet nozzle of a recording head 204 via an ink supply tube (not shown). In this type, the ink liquid jet nozzle and the ink cartridge 202 are moved simultaneously and therefore mutual position therebetween is not changed, so the ink supply tube need not be flexible. Members designated by numerals 201, 203, 205 and 206 respectively correspond to that of FIG. 6.

When the ink cartridge 202 becomes empty, it can be exchanged with new one relative to the recording head. It is noted however, since the ink cartridge is mounted on the carriage, a large ink cartridge can not be used, compared with the printer of FIG. 6.

First embodiment of present invention will now be described in detail with reference to FIGS. 1 and 2.

Figure 1A:
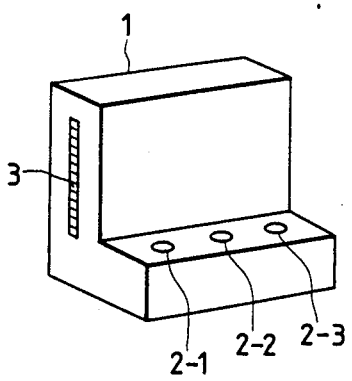
FIGS. 1A to 1B–3 are exploded perspective views showing a recording head and an ink cartridge according to a preferred embodiment of the present invention.
Figures 1, 1B:
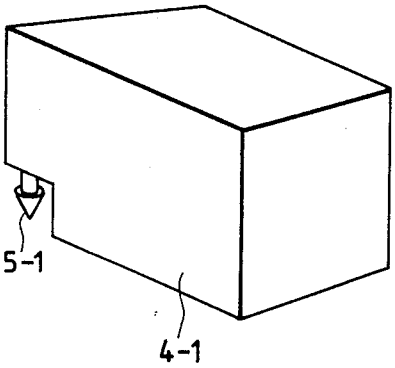
Figures 1, 1B, 2:
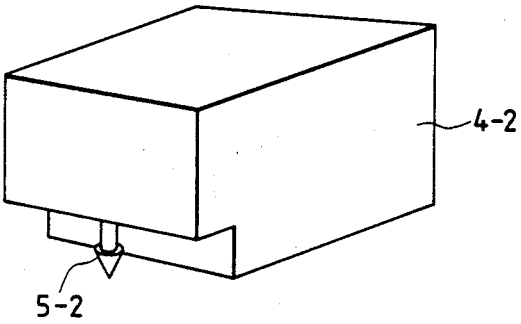
Figure 2A:
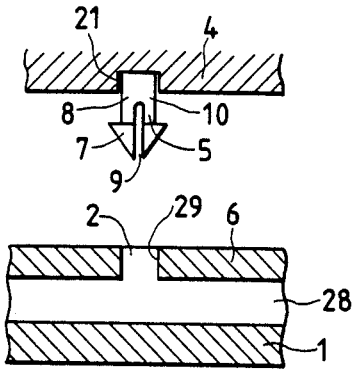
FIGS. 2A to 2C are sectional views showing the details of engaging or matching portions of FIG. 1 and the operation thereof.
Figure 2B:
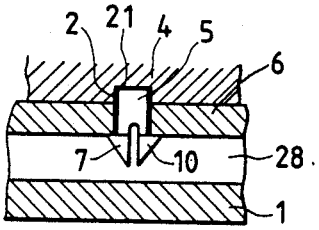
Figure 2C:
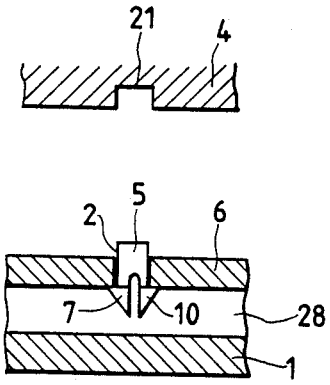
Figure 3A:
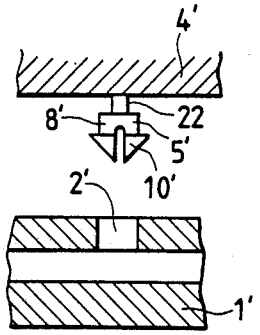
FIGS. 3A to 3C are sectional views showing the details of engaging or matching portions between a recording head and an ink cartridge according to a second embodiment of the present invention.
Figure 3B:
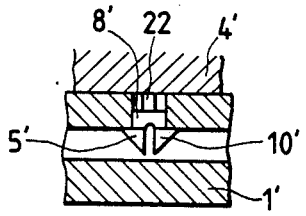
Figure 3C:
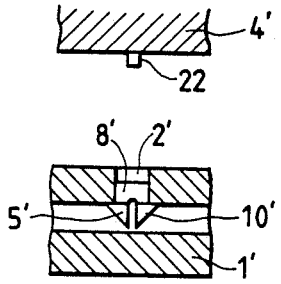

FIG. 1 is a perspective view showing the construction of a recording head and of ink cartridges in accordance with present invention. FIGS. 2A to 2C are sectional views showing in detail the construction and operation of their engaging sections. In this embodiment, both the recording head and the ink cartridge are arranged on the carriage.

Referring to FIG. 1, reference numeral 1 indicates an ink jet recording head, and reference numerals 4-1, 4-2 and 4-3 indicate ink cartridges. The recording head 1 and the ink cartridge 4 are retained on a carriage (not shown) in such a manner as to be able to engage each other. The recording head 1 and the ink cartridges 4 can be simultaneously attached to or detached from the carriage. The carriage can make a reciprocating movement with respect to a recording medium such as paper (not shown) within a predetermined range. Reference numeral 3 indicates nozzles through which ink is ejected or discharged. Information is recorded on the recording medium when the ink discharged from the nozzles 3 adheres to the recording medium.

Engaging sections 2-1, 2-2 and 2-3 allowing the recording head 1 to be engaged with the ink cartridge 4 are provided on the recording head 1 at three different positions. Every engaging section 2 has a configuration as shown FIG. 2; it consists of a round hole 29 having a predetermined diameter and made in a surface plate 6 provided over the recording head 1. A gap 28 having a predetermined dimension exists between this surface plate 6 and the recording head 1.

An engaging section 5 is provided on each ink cartridge 4 in correspondence with the engaging sections 2 of the recording head 1. Since the engaging sections 2 are provided at three positions in the recording head 1, three types of ink cartridge (4-1, 4-2 and 4-3) are prepared. These ink cartridges have their respective engaging sections 5-1, 5-2 and 5-3, each of which engages with only one of the three engaging sections 2-1, 2-2 and 2-3 of the recording head 1. Every engaging section 5 is formed as a pin 10, as shown in FIG. 2.

The pin 10 is composed of a cone-shaped section 7 serving as a claw and a cylindrical section 8 having a smaller diameter than the bottom surface of the claw section 7. The pin 10 includes an expanding slot 9 which extends from the top to an predetermined depth. The diameter of the cylindrical section 8 is approximately the same as that of the hole 29 of the corresponding engaging section 2 provided in the surface plate 6 of the recording head 1. The height of the claw section 7 is approximately the same as or somewhat smaller than that of the gap 28 in the engaging section 2 of the recording head 1. The pin 10 is made of a flexible material such as plastic. Provided in each of the ink cartridges 4 is a hole 21 having approximately the same diameter as the cylindrical section 8 of the pin 10.

In a new ink cartridge, part of the pin 10 is stuck into the hole 21, and the pin 10 is fixed to the ink cartridge 4 by a predetermined means. Unless a tensile force greater than a predetermined force is applied to it, the pin 10 can not be separated from the cartridge 4.

In this embodiment, up to three ink cartridges, i.e., cartridges 4-1, 4-2 and 4-3, can be set on the recording head 1 (service life of the recording head 1 is sum of that of three ink cartridge).

The operation of this embodiment having the above construction will now be described.

In practice, the above-described four components, i.e., the recording head 1 and the ink cartridges 4-1, 4-2 and 4-3, may be sold as one set, and users will then purchase this set as a whole.

Having purchased, for example, the recording head 1 and ink cartridges 4, sold as one set, the user of the ink jet printer may fit an ink cartridge, for example, the ink cartridge 4-1, onto the recording head. In this process, the engaging pin 10 of the ink cartridge 4-1 advances toward the position of the corresponding engaging section 2 in the recording head 1 (see FIG. 2A), and enters the hole of this engaging section 2. Since it is made of a flexible material and since an expanding slot 9 is provided in its tip section, the engaging pin 10 can be deformed and thereafter work its way into the hole of the corresponding engaging section 2. When it has been forced into the hole of the engaging section 2 and the engagement between the recording head 1 and the ink cartridge 4-1 has been completed, the claw or pawl section 7 is locked by the surface plate 6 of the recording head 1, as shown in FIG. 2B.

Having been thus engaged with each other, the recording head 1 and the ink cartridge 4-1 are attached to the carriage. When they have been attached to the carriage, the recording head 1 is operated, thereby recording information on a recording medium such as paper.

When the ink in the ink cartridge 4-1 has been consumed, the recording head 1 and the ink cartridge 4-1 are extracted from the carriage, and the ink cartridge 4-1 is removed from the recording head 1. In this process, the claw section 7 of the pin 10 is caught by the surface plate 6 of the engaging section 2-1, so that the entire pin 10 is drawn out of the ink, remaining in the engaging section 2-1 of the recording head 1.

Then, another ink cartridge, for example, the ink cartridge 4-2, is attached to the recording head 1. The engaging pin 10 is engaged with the engaging section 2-2 of the recording head 1 in the same manner as described above. The components thus engaged with each other are then attached to the carriage, and the recording head 1 is operated. When the ink has been consumed, the recording head 1 and the ink cartridge 4-2 are extracted from the carriage, the ink cartridge 4-2 being removed from the recording head 1. As a result of this process, the engaging pin 10 of the cartridge 4-2 remains in the engaging section 2-2 of the recording head 1, as in the above described case.

The remaining ink cartridge 4-3 is then attached to the recording head 1 in the same manner as described above, and the recording head 1 is operated.

When the ink in the cartridge 4-3 has been used up, the recording head can not be used any longer since all its engaging sections 2-1, 2-2 and 2-3 are occupied by the engaging pins 10. That is, no new ink cartridges 4 can be attached to the recording head 1 since their engaging pins can not be inserted into the engaging sections.

Accordingly, the user has to purchase a new set comprising the recording head 1 and ink cartridges 4-1, 4-2 and 4-3.

Thus, only three ink cartridges can be used for one recording head, which prevents recording heads from being used for a period longer than their service life; if a recording head has become out of order before one knows it, it can be prevented from continuing defective recording on paper or the like.

Since in the above embodiment the recording head 1 and the ink cartridge 4 are of the type capable of being simultaneously attached to and detached from the carriage, they have been described as adapted to be attached to the carriage after being engaged with each other. In the case of an ink jet printer of the type in which the recording head 1 and the ink cartridge 4 can be individually attached to and detached from the carriage, the recording head 1 may first be attached to the carriage, and then the cartridge 4 may be attached to the recording head 1. When replacing the ink cartridge 4 with a new one, the ink cartridge 4 alone may be removed, leaving the recording head 1 as it is.

A second embodiment of present invention will now be described.

Figures 1, 1B, 2, 3:
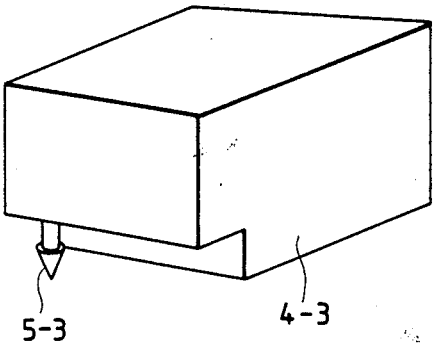

FIG. 3 is a sectional view showing in detail the construction and operation of the engaging sections of the second embodiment.

The second embodiment is the same as the first except for the configuration of the engaging sections 5' of the ink cartridge 4'. As in the first embodiment, the recording head 1' of this embodiment has engaging sections 2'-1, 2'-2 and 2'-3 at three different positions. In correspondence with these engaging sections 2'-1, 2'-2 and 2'-3, three types of ink cartridge 4'-1, 4'-2 and 4'-3 are prepared. These ink cartridges are equipped with respective engaging sections 5'-1, 5'-2 and 5'-3 which correspond to the engaging sections 2'-1, 2'-2 and 2'-3.

The engaging pin 10' of this embodiment has a neck section at the root of its cylindrical section 8'. That is, the root section of its cylindrical section 8' is formed as a small-diameter section 22, which is fixed to the cartridge 4'. The engaging pin 10' and the cartridge 4' may be formed integrally, or may be connected with each other by means of an adhesive or the like. When the ink in the ink cartridge 4', thus attached to the recording head 1', has been used up, the ink cartridge 4' is removed from the recording head 1'. The engaging pin 10' is then separated from the body of the ink cartridge 4' at the neck section 22, the engaging pin 10' remaining in the engaging section of the recording head 1'.

A third embodiment of present invention will now be described with reference to FIGS. 4 and 5.

Figure 4:
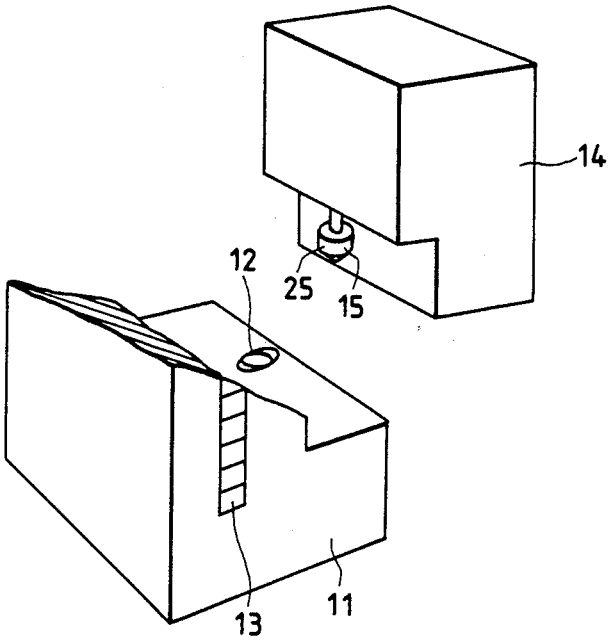
FIG. 4 is an exploded perspective view showing a recording head and an ink cartridge according to a third embodiment of the present invention.
Figure 5:
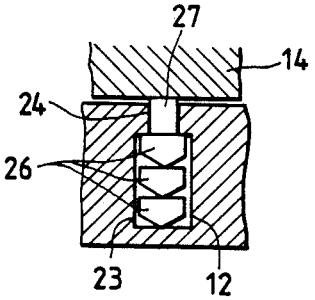
FIG. 5 is a sectional partial view showing the engagement between the recording head and the ink cartridge of FIG. 4.

FIG. 4 is a perspective view showing the construction of the recording head and of the ink cartridge of this embodiment, and FIG. 5 is a sectional view showing the operation of this embodiment. Also in this embodiment, both the recording head and the ink cartridge are attached to the carriage.

Reference numeral 11 indicates a recording head; reference numeral 13 indicates nozzles for ejecting ink; and reference numeral 14 indicates an ink cartridge.

As shown in FIG. 5, the engaging section 12 of the recording head 11 in accordance with this embodiment consists of a round hole 23 having a predetermined diameter and depth, and a communicating hole 24 having a smaller diameter than the round hole 23. The round hole 23 communicates with the exterior through the communicating hole 24. The depth of the round hole 23 is approximately three times the height of the claw section of an engaging pin provided in the ink cartridge 14 described below. The diameter of the communicating hole 24 is approximately the same as that of the neck section of the engaging pin provided in the ink cartridge 14. The recording head 11 has only one engaging section 12.

Provided in the ink cartridge 14 is an engaging section 15 situated at a position corresponding to the engaging section 12 of the recording head 11. The engaging section 15 consists of an engaging pin 25, which is composed of a claw section 26 and a neck section 27 having a smaller diameter than the claw section. When a tensile force is applied to the claw section 26, it can be separated from the neck section at its root portion. The engaging pin 25 is made of a flexible material such as plastic. In this embodiment, only one type of ink cartridge 14 is provided.

In this embodiment, the number of ink cartridges 14 that can be used for one recording head 11 is set as three. That is, when three ink cartridges 14 have been used on one recording head 11, the recording head is to be replaced with a new one.

The operation of this embodiment will now be described.

As in the first embodiment, the ink cartridge 14 is fitted onto the recording head 11, and the engaging pin 25 is inserted into the engaging section 12, making the recording head 11 ready for use. When the ink has been consumed, the ink cartridge 14 is removed from the recording head 11. In this process, the claw section 26 of the engaging pin 25 is caught by the upper end surface of the round hole 23, which causes the claw section 26 of the engaging pin 25 from being separated from the neck section 27 thereof, leaving the claw section 26 in the round hole 23.

Then, a new cartridge 14 is fitted onto the recording head. When the ink of this cartridge has also been used up, the ink cartridge 14 is replaced with a new one. This process also results in the claw section 26 being left in the round hole 23.

A third cartridge 14 is then fitted onto the recording head 11 (FIG. 5 shows the state where the third cartridge has been attached to the recording head 11). When the ink of this cartridge has been consumed, this recording head 11 can not perform recording any longer. If the user removes the third cartridge 14 from the recording head 11 and attempts to attach a new cartridge thereto, that can not be achieved since the round hole 23 of the recording head 11 has already been filled with three claw sections 26 and there is no room for a new claw.

This arrangement helps, for example, to prevent the recording head 11 from being used for a period longer than its predetermined service life.

While in the above-described three embodiments the recording head can not be used when three ink cartridges have been used on it, the number of ink cartridges that can be used for one recording head can also be set at two, or for or more, in accordance with the reliability of the recording head, the capacity of the ink cartridge, and so on.

Further, while in the above-described three embodiments the means for indicating the number of ink cartridges that have been used on a recording head consists of engaging pins provided on the ink cartridges and engaging sections in the form of holes engaging with the engaging pins, it goes without saying that the number of ink cartridges that have been used on a recording head can be indicated by various means other than those described above.

Heretofore, while the mechanical ink cassette history forming means was explained, FIGS. 12 to 15 show other embodiments of electrical ink cassette history forming means wherein the number of the exchanged cassettes is counted or read.

Before explaining these electrical ink cassette history forming means, examples of ink cassette holding mechanisms suitable to be used with the relatively large exchangeable ink cassette as shown in FIG. 6 will be explained with reference to FIGS. 8 to 11. It should be noted that the present invention is not limited to these examples, since, normally, the cassette is not unnecessarily dismounted from the recording head once it has been mounted. In these examples, since the ink cartridge can be dismounted from the recording head at any time, it is feared that the operator may dismount the ink cartridge as to leave the ink cartridge in the dismounted condition. In this case, since it is difficult to judge whether such ink cartridge is a new ink cartridge or an old ink cartridge, it is preferable to use the ink jet printer constructed so that the ink cartridge can not be detached from a fixing member to which the cartridge is attached, until the ink housed in the ink cartridge is reduced to a predetermined amount.

Figure 8:
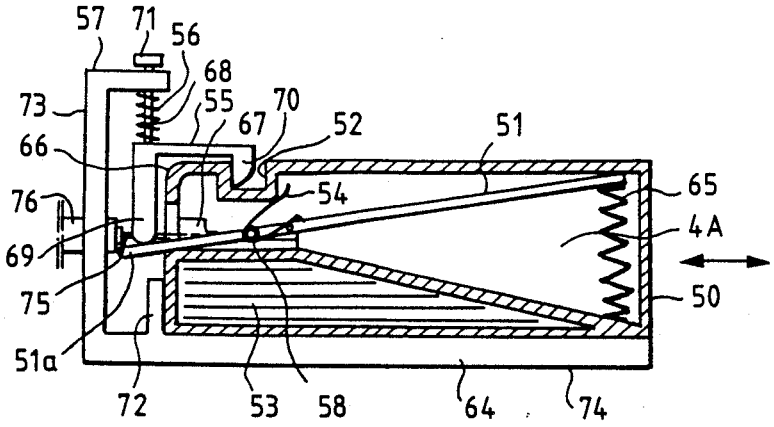
FIG. 8 is a sectional elevational view of a first embodiment of an ink cartridge holding mechanism which is applicable to the present invention.
Figure 9:
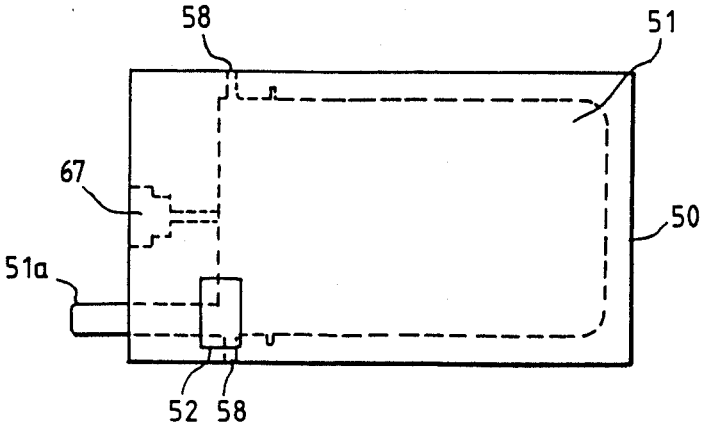
FIG. 9 is a plan view of the ink cartridge according to the first embodiment of FIG. 8.
Figure 10:
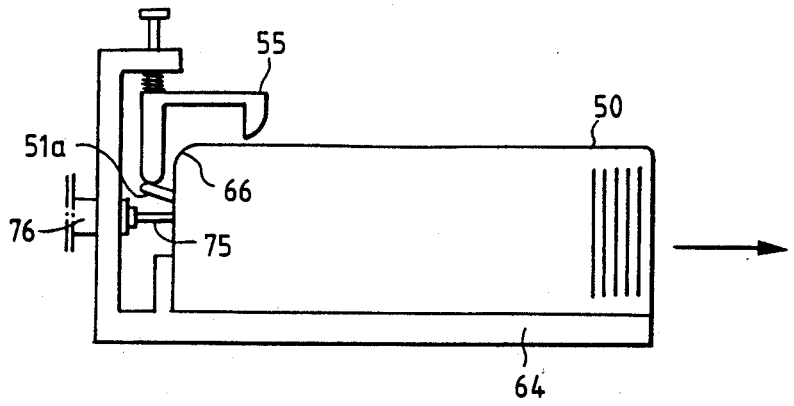
FIG. 10 is an elevational view showing a condition that a residual amount of ink in the ink cartridge of FIG. 8 reaches a predetermined amount.

FIGS. 8 to 10 show a first embodiment of an ink cartridge holding mechanism for attaching the ink cartridge to the fixing member, where FIG. 8 is an elevational view of the mechanism (with showing the ink cartridge in a sectional view), FIG. 9 is a plan view of the ink cartridge, and FIG. 10 is an elevational view of the mechanism in a condition that the ink in the cartridge is reduced to the predetermined amount.

The ink cartridge 50 is provided at its interior with an ink accommodating bag 65 for accommodating the ink 4A therein, and an ink lever 51. The ink lever 51 is rotatable around an ink lever pivot shaft 58 so as to change the ink in the bag and the volume of the bag 65. Incidentally, in the illustrated embodiment, the ink lever 51 is biased toward an anti-clockwise direction by means of a spring 54 arranged around the ink lever pivot shaft 58. By devising the installation of the ink cartridge 50, the spring 54 may be omitted. Further, the ink lever 51 has an extension 51*a* protruding out of the ink cartridge 50. The ink cartridge 50 is provided at its upper surface with a recess 52 for receiving a stopper 55. In addition, the ink cartridge 50 has a chamfered portion 66 at its left upper edge (FIG. 8). The reference numeral 67 designates an opening for inserting an ink drawing tube such as an injection syringe, which opening 67 is filled with a filler such as silicone rubber or isobutylene-isoprene rubber. The reference numeral 53 designates exhaust ink reservoir for storing the exhaust ink recovered from the nozzles of the recording head by a suction force or compression force.

The stopper 55 is mounted on the fixing member 64 for movement in an up-and-down direction, by means of a stopper holder 57 and a slider 68. The stopper 55 comprises an inverted U-shaped member having a left longer pawl 69 and a right shorter pawl 70. The right pawl 70 has a chamfered portion at its lower right edge. The slider 68 is provided at its upper end with a flange portion 71. By abutting the flange portion 71 against the stopper holder 57, the stopper 55 is prevented from shifting below a predetermined position. Incidentally, the stopper 55 is biased downwardly by means of a coil spring 56 arranged between the stopper holder 57 and the stopper 55 outwardly of the slider 68. The directions of movement of the ink cartridge 50 with respect to the fixing member 64 correspond to directions shown by the arrows in FIG. 8. The fixing member 64 has an abutment 72 for limiting the insertion movement of the ink cartridge 50 when the ink cartridge 50 is mounted on the fixing member 64.

For example, when applied to the printer as shown in FIG. 6, the fixing member 64 may be attached to a predetermined position within the ink jet printer. Then, a root portion 76 of the ink drawing tube 75 is connected to a flexible ink supplying tube. On the other hand, when applied to the printer as shown in FIG. 7, a lower surface 74 of the fixing member 64 may be fixed to a side of the recording head 204, for example, in such a manner that a left side 73 of the fixing member 64 is turned downwardly. In case of FIG. 7, the root portion 76 of the ink drawing tube 75 is directed to the ink drop jet nozzles through a predetermined inverted U-shaped conduit (not shown).

In operation, since the volume of the ink accommodating bag 65 of the ink cartridge 50 is large when the ink is filled within the bag 65, the ink lever 51 is inclined so that the left end thereof is lower than the right end thereof, in opposition to the bias force of the torsion spring 54.

When such ink cartridge is mounted on the fixing member 64, the ink cartridge 50 is inserted or shifted leftwardly (FIG. 8). Incidentally, when the fixing member 64 is attached to the printer of FIG. 6 as mentioned above, the cartridge 50 is shifted leftwardly (FIG. 6), whereas, when the fixing member 64 is attached to the printer of FIG. 7, the cartridge 50 is shifted downwardly (FIG. 7).

Consequently, the chamfered portion of the right pawl 70 of the stopper 55 is abutted against the chamfered portion 66 of the ink cartridge 50 and then overrides the latter, thus lifting the stopper 55. A further leftward movement of the cartridge 50 causes the pawl 70 to insert into the recess 52 as shown in FIG. 8, and at the same time causes the cartridge to abut against the abutment 72. Meanwhile, the ink drawing tube 75 such as the injection syringe penetrates through the filler positioned in the opening 67 to reach the interior of the ink accommodating bag 65.

In this condition, the ink housed in the ink bag 65 is drawn through the ink drawing tube 75 to be directed to the ink drop jet nozzles, whereby the ink is consumed. Consequently, since the volume of the ink bag 65 is gradually decreased, the ink lever 51 is gradually rotated in a clockwise direction with the aid of the bias force of the torsion spring 54. When the ink lever 51 abuts against the left pawl 69 of the stopper 55, the latter is lifted upwardly.

As the ink continues to be consumed, when the residual mount of the ink in the bag reaches the predetermined amount, the lower end of the right pawl 70 of the stopper 55 is shifted above the upper surface of the ink cartridge, as shown in FIG. 10. In this condition, by retracting the ink cartridge 50 rightwardly, the ink cartridge 50 can be removed or dismounted from the fixing member 64. Then, a new ink cartridge or the previous ink cartridge filled with the ink again (when the cartridge can be replenished with the ink) can be inserted into and attached to the fixed member 64 as mentioned above, thus preparing the use of ink.

In the illustrated embodiment, since the right pawl 70 of the stopper 55 is penetrated into the recess 52 of the cartridge so long as the residual amount of ink in the ink bag 65 is above the predetermined amount, the operator can not remove the ink cartridge 50 from the fixing member 64.

Incidentally, in the illustrated embodiment, when it is so designed that the up-and-down movement of the stopper 55 can be observed from outside of the printer and an appropriate scale is provided along the up-and-down movement of the stopper 55, the residual amount of the ink in the ink bag 65 can be indicated by the up-and-down movement of the stopper 55, whereby the operator can easily know the time when the residual amount of the ink reaches the predetermined amount, i.e., the timing of the exchange of the ink cassette. Incidentally, the indication of the residual amount of the ink may be effected by providing a microswitch cooperating with the stopper to indicate the residual amount or the presence of the ink on a displaying portion.

Figure 11:
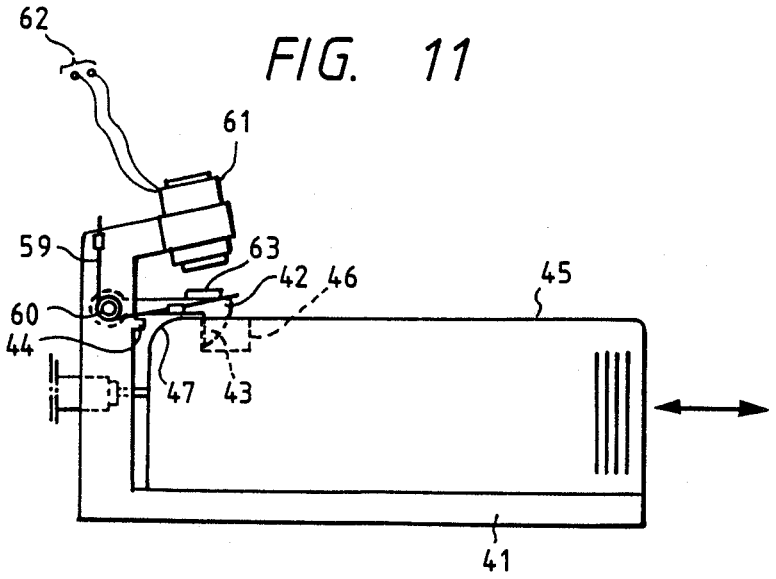
FIG. 11 is an elevational view showing an ink cartridge holding mechanism according to a second embodiment, which is applicable to the present invention.

FIG. 11 is an elevational view showing another embodiment of an ink cartridge holding mechanism.

In this embodiment, a fixing member 41 includes an L-shaped stopper 42 rotatable around a pivot shaft 60 and having a downwardly directed pawl 43. The pawl 43 has a chamfered portion at its right side. A metal plate 63 is arranged on an upper surface of the stopper 42 at a predetermined position. The stopper 42 is biased toward a clockwise direction by means of a torsion spring 59 arranged around the pivot shaft 60. The fixing member 41 has a projection 44 which serves to maintain the stopper 42 biased by the torsion spring 59 in a position where the stopper 42 is abutted against the projection 44. The fixing member 41 further includes an electro-magnet 61 arranged above the stopper 42. When the stopper 42 is rotated in an anti-clockwise direction, the metal plate 63 attached to the stopper 42 can contact the electro-magnet 61. In this condition, the lower end of the pawl 43 is positioned above the upper surface of the ink cartridge 45. The reference numeral 62 designates electric wirings for supplying the current to the electro-magnet 61. Incidentally, the electro-magnet is controlled so that the current is supplied to the electro-magnet only when the fact that the residual amount of the ink reaches the predetermined amount is detected by a residual amount detecting means which will be described later.

The ink cartridge 45 in this embodiment is provided at its upper surface with a recess 46 for receiving the stopper, as in the cartridge 50 in the previous embodiment. Further, the ink cartridge 45 has also a chamfered portion 47 at its right upper edge. The ink cartridge 45 is further provided at its interior with an ink accommodating bag or ink absorber for holding ink therein (similar to the aforementioned ink accommodating bag 65), an opening (similar to the aforementioned opening 67) which is filled with the filler such as silicone rubber and the like, and an exhaust ink reservoir (similar to the aforementioned ink reservoir 53), which elements are not seen in FIG. 11.

Incidentally, the residual amount detecting means for detecting the residual amount of the ink by negative pressure is arranged on a frame of the printer.

In operation, when the ink cartridge 45 is not mounted on the fixing member 41, the stopper 42 is abutted against the projection 44 by the bias force of the torsion spring 59.

In this condition, as the ink cartridge 45 is shifted to the left (FIG. 11), the chamfered portion of the pawl 43 of the stopper 42 is abutted against the chamfered portion 47 of the cartridge 45 and then overrides the latter, thus lifting the stopper 42 upwardly. A further movement of the ink cartridge 45 causes the pawl 43 of the stopper 42 to penetrate into the recess 46 of the ink cartridge, thus fixing the cartridge to the fixing member 41.

In this condition, the ink in the cartridge is used to record the information on the recording medium such as the paper by discharging the ink from the ink jet nozzles. In this case, since the electro-magnet 61 is so controlled that the current is supplied to the electro-magnet only when the fact that the residual amount of the ink reaches the predetermined amount is detected, if the operator tries to retract the ink cartridge rightwardly, he can not remove the ink cartridge from the fixing member.

Then, when the negative pressure detector detects the negative pressure to detect the fact that the residual amount of the ink reaches the predetermined amount, the current is supplied to the electro-magnet 61, with the result that the stopper 42 is attracted by the electro-magnet 61. At the same time, the fact that the residual amount of the ink reaches the predetermined amount is indicated on the displaying portion of the ink jet printer.

Accordingly, the operator can retract the ink cartridge from the fixing member in the printer, thus permitting the exchange of the cartridges or the replenishment of the ink.

Incidentally, in this second embodiment, while an example that the residual amount of the ink is detected by the negative pressure detector was explained, any other residual amount detecting means may be used. For example, an electric detecting means wherein two electrodes are arranged in the ink bag so that when the ink exists between the electrodes the current flows between the electrodes whereas when the ink does not exist between the electrodes the current does not flow between the electrodes, whereby the residual amount of the ink is detected by the absence of ink between the electrodes may be adopted.

Incidentally, it should be noted that the ink cartridge holding mechanism for preventing the ink cartridge from releasing the fixing member until the residual amount of the ink is reduced to the predetermined amount is not limited to the above-mentioned first and second embodiments, and that appropriate alterations or modifications are included in the present invention.

Further, it should also be noted that the construction of the ink cartridge and/or ink drawing means for drawing the ink from the ink cartridge are not limited to the above-mentioned first and second embodiments.

According to the present invention, in the ink jet printer, since the ink cartridge accommodating the ink can not be removed from the fixing member until the residual amount of the ink reaches the predetermined amount, the ink cartridge can not be dismounted so long as the ink remains in the cartridge more than the predetermined amount. On the other hand, when the residual amount of the ink is reduced to the predetermined amount or less, the ink cartridge can be removed from the printer. This can normally be limited only when the operator exchanges the ink cartridges or replenishes the new ink to the empty ink cartridge.

Figure 12:
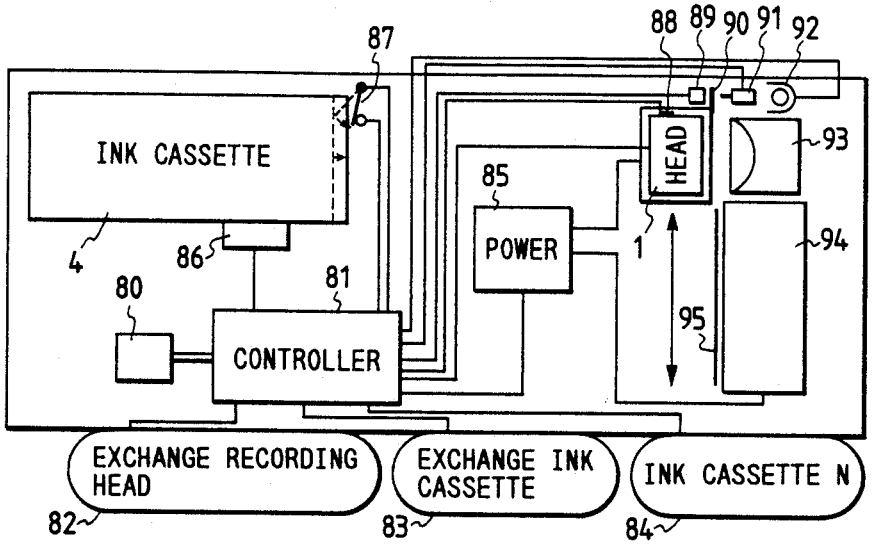
FIG. 12 a schematic constructural view of an ink jet printer according to the present invention.

FIG. 12 is an upper view of an embodiment using a drill type recording means as ink cassette recording means. In this FIG. 12, reference numeral 94 shows a platen roller which rotates in a direction so that the recording medium 95 is conveyed from the bottom to the top in FIG. 12. Numeral 1 shows an ink jet recording head which is attachable to or detachable from the serial type carriage (not shown) which is reciprocally movable in the direction shown by the arrow. Numeral 85 shows a driving source which is connected to the carriage, motor platen 94 through an actuation transmission changing means (not shown). Numeral 93 shows recover means disposed opposing to the home position of the recording head and includes the normal or conventional capping member for the recording surface, the pump for absorbing or pressurizing recover. Numeral 88 shows a sensor for detecting the exchange of recording head and provided in an exchangeable position (normally in the hOme position) of the carriage or recording head. The sensor 88 generates a reset signal by detaching operation of the old recording head and attaching operation of the new recording head and transmits it to a controller 81 which functions as the central controlling portion. Numeral 90 shows a thin plate of non-transparent material which can be drilled. The thin plate 90 opposes drilling means 91 at the home position and can be positioned in a location between a light source for drill irradiation which is provided above drilling means 91 and a light receiving element 89 provided at the location where the light from the light source 92 reaches through the through hole of drilled thin plate 90.

Numeral 87 shows a detecting sensor for the new ink cassette which is made ON by mounting of the new ink cassette 4 onto the apparatus body, the detected result of which is transmitted to the controller 81. On the basis of the signal from the detecting sensor 87 drilling means 91 carries out new drilling of the thin plate 90. Numeral 86 shows detecting means for detecting residual ink amount in the ink cassette 4, and transmit an ink absense signal to the controller 87 when residual ink amount in the cassette decreases below the predetermined level. The controller 81 judges corresponding to setting means 80 cf the ink cassette which is pre-set regarding to life time of the recording head and compares with the signal from residual ink amount detecting means 86 as well as the number of drilled holes detecting means 82, 92, and puts on an ink cassettes exchange display 83 when the detected number of drilled hole is equal to the number of ink cassette and no ink remains.

In the case the number of drilled holes does not reach the number of cassettes, cassette, the controller 81 puts on the ink cassette exchange display 83 corresponding to the absense of residual ink amount, and also puts on the ink cassette number display 84 displaying that the using cassette is the N-th cassette with respect to the recording head. Because this display 84 can be displayed by the number of drilled holes, memory means for the ink cassette number N need not be provided.

According to the above construction, the number of used ink cassettes relative to the particular recording head can be detected instantaneously, and even if the recording head is mounted to or dismounted from the apparatus body as long as the ink cassette 4 is left on the apparatus body, the ink supply corresponding to the lift time can be carried out since the number of ink cassettes used by the recording head is securely memorized. As for drilling means 91, one which shifts to another position to drill a new hole where it can be detected optically after being drilled, is preferable.

By adopting the construction of FIGS. 8 to 10 as the residual amount detecting means and mount holding means of the ink cassette 4, additional or useless mounting-dismounting operations of the ink cassette can be omitted, which enables the ink cassette direction number more securely. Thus, responsibility of the controlling effect of the present invention can be largely improved or increased. Incidentally, the exchange detection of the ink cassette can be carried out corresponding to movement of the moving flange 71.

Figure 13:
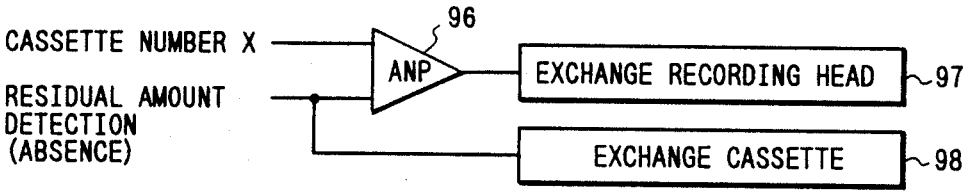
FIG. 13 is a block diagram of a main part of the ink jet printer of FIG. 12.

FIG. 13 shows an AND circuit portion 96 which can be used as the put-on control of the recording head exchange display 82 and ink cassette exchange display 83. By using this FIG. 13, the explanation that concept of the present invention can be carried out by usage of the well known circuit such as counter or memory will be made.

Figure 15:
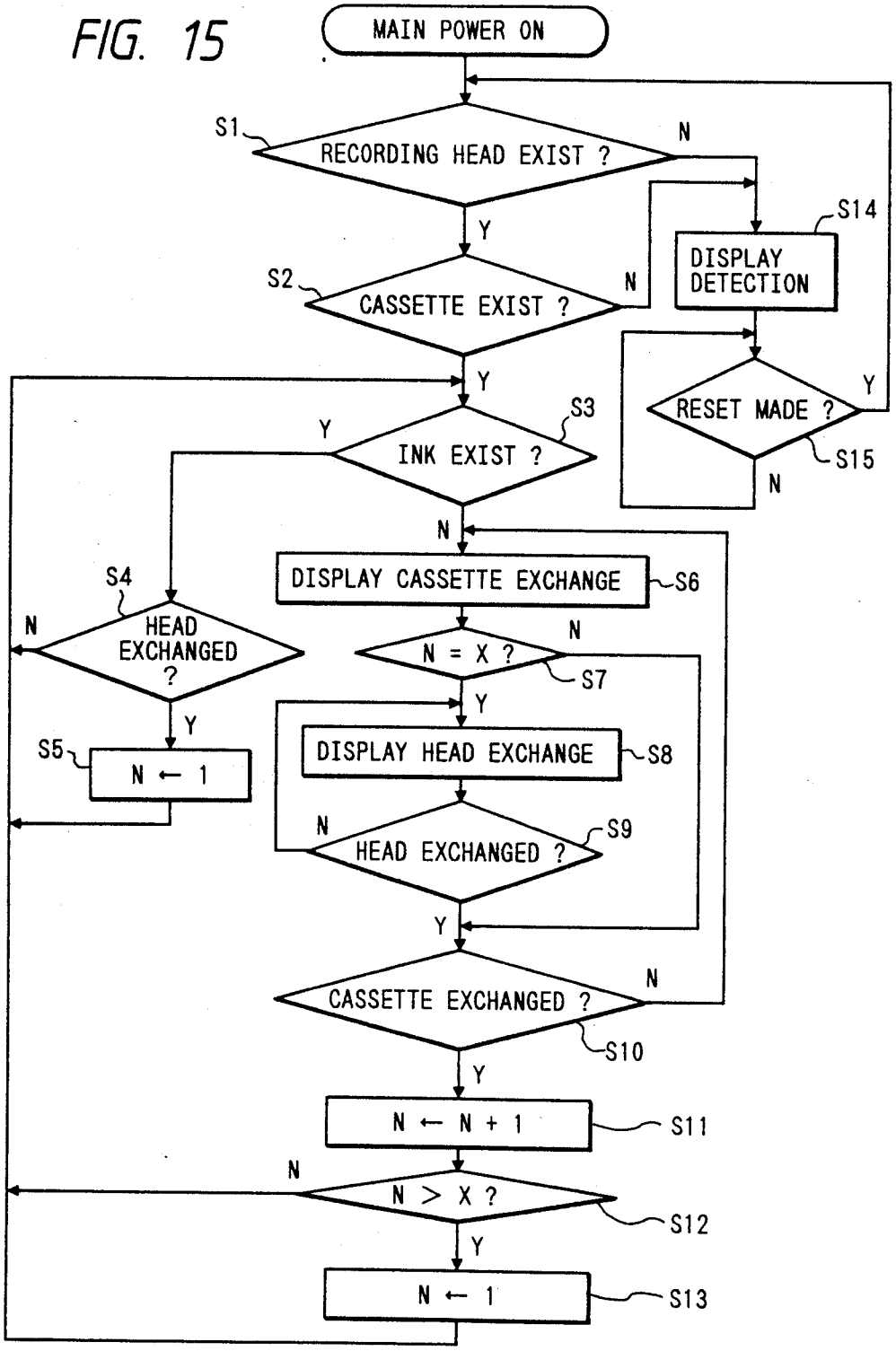
FIG. 15 is a flow chart for electrically storing the number of used ink cartridges.

In detail, the apparatus includes the exchange detection means 88 for the recording head 1, ink cassette exchange detecting means 87, residual ink detecting means 86, ink cassette setting (or memory) means 80 suitable for life time of the recording head 1 to be used. Explanation is made provided that setting means 80 has an addition type counting function counting corresponding to the recording head of the ink cassette, as well as reset function of the counter due to exchange of the recording head. FIG. 15 is a flow chart for explaining the operation.

In FIG. 15, detection display in the step S14 is made when one of the recording head presence-absence judgement in the step S1 or ink cassette presenceabsence judgement in S2 is lacking. Both steps S1 and S2 are recovered to clear the reset presence-absence judgement in the step 15, then the main process starts.

At first, the ink presence-absence judgement (step S3) in the ink cassette is carried out, and judgement that ink is present is made, the head exchange presence-absence judgement (step S4) is carried out. This step S4 is not necessary in the normal process, but considering the occasion that the user has exchanged the recording head, the counter N is set to 1. Although the recording is carried out in the ink present state in the step S3, when exchange of the ink cassette becomes necessary due to the judgement of residual ink amount detecting means the cassette exchange display is made in the step S6, which display continues until the cassette is exchanged (until judgement of the step S10 is made).

During the above process, advances are made in which the cassette number N memorized in setting means 80 (that is, the order of the ink cassette which is judge no residual ink is left therein relative to the recording head 1) and the number X corresponding to the cassette number pre-set corresponding to the recording head 1 are compared (in the step S7), and when they are equal to each other the head exchange display (step S8) is made in addition to the cassette exchange display. If the head is exchanged, the counter is reset to made the cassette number N into 1, as shown in the step S4, while the cassette is exchanged the counter is set or added into N+1 (step S11).

The process is returned to the initial point after both of the head and cassette are exchanged, then the above process is carried out.

Incidentally, in the case when the value of (N+1) exceeds the predetermined number X, which naturally means that a new ink cassette is used for the new recording head, the counter N is reset into 1. In the case that the added counter N is below the predetermined number X, which means the recording head is still usable, the recording head is used until predetermined number of ink cassette are used with carrying out the residual ink amount detection and addition of the counter. It is noted that all of memories used are nonvolatile. In any way, by usage of the counter and memory the present invention can be carried out.

The predetermined cassette number X corresponding to the recording head can be fixed value when the single head is provided. However, in the case plural kinds of recording heads can be used, setting means 80 can be made as a variable type so that the cassette number corresponding to life time thereof can be memorized automatically or manually corresponding to the recording head.

Returning to FIG. 13, it is possible to provide counter means which is reset by simply attaching the recording head. The exchange number during usage of the recording head is additionally counted, and the recording head exchange display 97 can be carried out based on AND signal of the cassette number signal X from means generating signal when the added number reaches the predetermined number X (value corresponding to life time of the head) and signal when the residual ink amount becomes empty. Numeral 98 shows the exchange element per one cassette.

Figure 14:
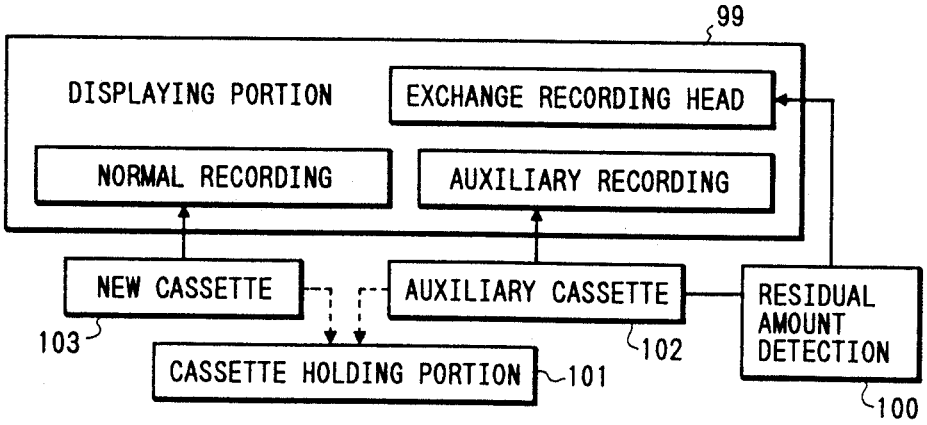
FIG. 14 is a block diagram of an ink jet printer according to another embodiment of the present invention.

FIG. 14 shows a state prepared by combining the new cassette, auxiliary cassette and recording head relative to the above predetermined number X (normally 2 to 10). Here, life time of the recording head is set to finish in the new cassette, in the case life time of the recording head relative to the using ink has resultantly been extended due to the ink vapor resulted from few times usage of the recording head, and in the case absorbing, pressurizing recovery by the pump is often carried out by recovery means of the recording head, life time of the discharge element is increased. Accordingly, life time of the recording head can be fully satisfied by using the auxiliary cassette 102 whose shape is selected as that of the new cassette 103, although the ink amount thereof is rather smaller than the new cassette 103. However, there is the cassette among auxiliary cassettes for which the recording head satisfy the life time. In such a case, the display is made during the auxiliary recording to alarm the fact to the operator.

Numeral 99 is a display portion and comprises a normal recording display, auxiliary recording display and a recording head exchange display. As recording means for the prevent invention, a counter style one of FIG. 13 can be used Numeral 101 shows a cassette holding portion into which only one of the new cassette 103 or auxiliary cassette 102 is inserted, the detail of which is shown in FIG. 8. The residual ink detecting means 100 can be a conventional one but also can be replaced by modified embodiment in which only mounting of the auxiliary cassette 102 is detected when the counter is absent, and indicating exchange of the recording head by detecting the residual ink amount of the auxiliary cassette 102.

In any way, according to the present invention, because the number of ink cassettes usable for the recording head can be pre-set to carry out exchange of the recording head corresponding to the ink consumption corresponding to the above number of the ink cassette, secure and high quality printing becomes possible.

According to the present invention, in the ink jet recording system in particular in the recording head or recording device of bubble jet system, various remakable advantages can be obtained.

Since the film boiling of the bubble jet system has a large shock force, a great deal of effort is made for the film formation of the element, but it is rather expensive and has a short life time. There are some examples which have longer life times than the apparatus body. However, in view of the fact that the recording head which is disposable and can be purchased at low cost, the present invention has great significance.

As for typical construction and principle therefor, U.S. Pat. Nos. 4,723,129 and 4,740,796 can be advisable. The system can be applied to so-called on-demand type as well as continuous type, but the former is more desirable for the following reason. In the case of on-demand type, to the electro-mechanical converting member which is disposed the sheet of liquid path on which the liquid (ink) is held at least one actuating signal giving sudden temperature increase corresponding to the recording information and goes over the film boiling is applied, to generate the thermal energy at the electro-mechanical converting member to thereby cause the film boiling at the acting surface of the recording head, so that the air bubble in the liquid (ink) can be formed exactly corresonding to the actuating signal. The liquid (ink) is discharged through the discharge opening due to growth and shrinkage of the air bubble to thereby form at least one droplet. Using the actuating signal as the pulse configuration is convenient to carry out the ink discharge excellent in response since the growth and shrinkage of the air bubble is carried out immediately and properly. The actuating signals of this pulse configuration which are disclosed in U.S. Pat. Nos. 4,463,359 and 4,345,262 are suitable. In the case the conditions disclosed in U.S. Pat. No. 4,313,124 which is related to the temperature increase at the heat acting surface is used, more excellent recording can be effected.

Incidentally, in addition to the construction of recording head comprising the combination of discharge opening, liquid path and electro-mechanical converter which is described in the above patents (linear liquid path or normal liquid path), the construction in which the heat acting surface is disposed in the bent or curl area which is for example disclosed in U.S. Pat. Nos. 4,558,333 and 4,459,600 is included in the present invention. Furthermore, the construction in which the slit common to plural electro-mechanical converters is made the discharge portion for the electro-mechanical converter which is for example disclosed in Japanese Patent Laid-open No. 59-123670, and the construction in which the opening for absorbing the pressure wave of thermal energy is corresponded to the discharge portion which is for example disclosed in Japanese Patent Laid-open No. 59-138461 can be adopted to the present invention.

As for the full-line type recording head, having a length corresponding to the maximum width of the recording medium capable of being recorded by the recording device, the construction is that in which length is satisfied by combination of plural recording heads disclosed in the above U.S. Pat. Nos., and the construction of single recording head formed integrally. In any case, the above advantage can be shown according to the present invention.

Furthermore, as for the recording mode of the recording device, in addition to the recording mode only for the main color such as black or the like, to the device having at least one of the plural colors of different colors or full color by mixing colors which is made by constructing the recording head integrally or combining plural recording heads, the present invention can be applied.

Summing up, according to the one aspect of present invention, it is possible to omit the step for adhering the discharge opening forming member (orifice plate) in the assembling process of the recording head, which enables to omit or exclude the positioning upon adhering and to overcome the disadvantage such as clogging in the liquid path since no adhesive agent is used. Thus, the whole of the manufacturing process of the recording head can be simplified. In the case the discharge opening forming member is partially thinned to form the discharge opening thereat, formation of the discharge opening is simplified and length of the liquid flow path located in front of discharge energy generating element can be shortened.

I claim:

1. An ink jet printer comprising:

a first supporting mechanism for removably supporting an ink jet recording head;

a second supporting mechanism for removably supporting an ink cassette accommodating ink to be supplied to said ink jet recording head; and a recording means provided in said printer or in said ink jet recording head mounted on said printer, for recording the number of said ink cassettes applied to said ink jet recording head mounted on said printer.

2. An ink jet printer according to claim 1, wherein said second supporting mechanism includes a mechanism for holding said ink cassette on said ink jet recording head.

3. An ink jet printer according to claim 1, further including a residual amount detection means for detecting the fact that a residual amount of the ink in said ink cassette is reduced to a predetermined amount or less, and means for indicating the necessity of the exchange of said recording head when said residual amount detection means detects the fact that the ink in a last ink cassette is reduced to said predetermined amount or less, said last ink cassette corresponding to a last one among a predetermined number of said ink cassettes recorded by said recording means.

4. An ink jet printer according to claim 3, wherein said residual amount detection means includes a holding means for non-removably holding the ink cassette in said printer so long as the residual amount of the ink is above the predetermined amount and for permitting removal of said ink cassette when the residual amount of the ink is reduced to said predetermined amount or less.

5. An ink jet printer according to claim 1, further including a residual amount detection means for detecting the fact that a residual amount of the ink in said ink cassette is reduced to a predetermined amount or less, and wherein said residual amount detection means includes a holding means for non-removably holding said ink cassette in said printer so long as the residual amount of the ink is above the predetermined amount and for permitting removal of said ink cassette when the residual amount of the ink is reduced to the predetermined amount.

6. An ink jet printer according to claim 5, wherein said holding means has an engagement member for non-removably holding said ink cassette by connecting to said ink cassette with recess-projection engagement, said engagement member releasing said ink cassette when the residual amount of the ink in said ink cassette is reduced to the predetermined amount or less.

7. An ink jet printer according to claim 1, wherein said recording means comprises a nonvolatile memory for storing the number of said ink cassettes applied to said ink jet recording head.

8. An ink jet printer according to claim 7, further including a displaying means for indicating the number of said ink cassettes stored in said nonvolatile memory and a residual amount detection means for detecting the fact that a residual amount of the ink in said ink cassette is reduced to a predetermined amount or less, and wherein said residual amount detection means includes a holding means for non-removably holding said ink cassette in said printer so long as the residual amount of the ink is above the predetermined amount and for permitting removal of said ink cassette when the residual amount of the ink is reduced to the predetermined amount or less.

9. An ink jet printer according to claim 1, wherein said recording means comprises means for perforating said ink jet recording head mounted in said printer.

10. An ink jet printer according to claim 9, further including an optical means for detecting the number of the perforations formed in said ink jet recording head, and means for indicating the necessity of the exchange of said recording head when the ink in a last ink cassette is reduced to said predetermined amount or less, said last ink cassette corresponding to a last one among a predetermined number of said ink cassettes applicable to said ink jet recording head and corresponding in order to the number of perforations detected by said optical means.

11. An ink jet printer according to claim 6, wherein said ink cassette comprises:

an engagement portion by which said engagement member of said ink jet printer is engaged and a shiftable member for shifting said engagement member to release it from said engagement portion in response to reduction of ink housed in said ink cassette.

12. An ink jet printer according to claim 1, wherein said ink jet recording head comprises an area on which the number of said ink cassettes is recorded by said recording means.

13. An ink jet printer according to claim 12, wherein said area of said recording head comprises a thin plate to be perforated.

14. An ink jet printer comprising:

means for removably supporting an ink jet recording head;

an ink cassette holding portion for removably holding either a normal recording ink cassette accommodating ink to be supplied to said ink jet recording head or an auxiliary recording ink cassette accommodating ink less than the ink in said normal recording ink cassette; and means for indicating an auxiliary recording mode of using auxiliary recording ink in response to said auxiliary recording ink cassette being mounted on said ink cassette holding means.

15. An ink jet printer according to claim 14, further including means for indicating the necessity of the exchange of said ink jet recording head when the ink in said auxiliary recording ink cassette is consumed.

16. An ink jet recording unit incorporating an ink jet recording head to be mounted in an ink jet printer and ink cassette means to be mounted on said ink jet recording head to supply ink to the latter, wherein:

said ink cassette means comprises a plurality of exchangeable ink cassettes to be applied to said ink jet recording head, each of said ink cassettes including a separating portion for forming a history of each said ink cassette on said ink jet recording head when each ink cassette is applied to said ink jet recording head.

17. An ink jet recording head on which an ink cassette is removably mounted, comprising:

a receiving portion for receiving ink from an ink supply portion of said ink cassette when said receiving portion is engaged with said ink supply portion, said receiving portion holding a separating member of said ink supply portion when said ink cassette is removed from said ink jet recording head and being capable of receiving only a predetermined number of said separating members of said ink cassettes corresponding to the service life of said ink jet recording head.

18. An ink jet recording head holding first and second ink cassettes, comprising:

an ink receiving portion in correspondence to said first ink cassette;

an ink receiving portion in correspondence to said second ink cassette; and each of said ink receiving portions preventing the mounting of a further cassette thereon when a history for indicating the use of the ink cassette is formed thereon after said ink cassette has been mounted thereon.

19. An ink jet recording head according to claim 18, further including a plurality of ink passages each communicating with one of a plurality of ink discharge openings for discharging recording ink and a plurality of thermal energy generating elements provided in correspondence to said ink passages, wherein said thermal energy generating elements generate thermal energy for discharging the ink by creating bubbles due to film boiling in said respective ink passages, and the number of said ink receiving portions of said ink jet recording head is determined by the service life of said ink jet recording head.

20. An ink cassette removable with respect to an ink jet recording head, comprising:

means for forming a history of said ink cassette on said ink jet recording head when said ink cassette mounted on said ink jet recording head is removed from said ink jet recording head.

21. An ink jet printer comprising an ink jet recording head portion and at least one exchangeable ink cartridge for supplying ink to said ink jet recording head portion; and a history forming means for forming a history of the number of said ink cassettes applied to said ink jet recording head portion.

22. An ink jet printer according to claim 21, wherein said history forming means comprises a plurality of engagement portions formed on said ink jet recording head portion, and a single engagement portion formed on at least one ink cartridge and selectively engageable with one of said engagement portions of said ink jet recording head portion.

23. An ink jet printer according to claim 22, wherein, when said engagement portion of at least one said ink cartridge is engaged by a selected one of said engagement portions of said ink jet recording head portion, said selected engagement portion can not be used again.

24. An ink jet printer according to claim 21, wherein said history forming means comprises engagement portions formed on said ink jet recording head portion, and a counter engagement portion formed on said at least one ink cartridge and engageable with one of said engagement portions of said ink jet recording head portion, and wherein, when said counter engagement portions of said at least one ink cartridge is engaged by one of said engagement portions of said ink jet recording head portion, said counter engagement portion of said at least one ink cartridge remains partially or wholly in the one of said engagement portions of said ink jet recording head portion.

* * * * *

UNITED STATES PATENT AND TRADEMARK OFFICE

CERTIFICATE OF CORRECTION

PATENT NO. : 4,970,533 Page 1 of 3

DATED : November 13, 1990

INVENTOR(S) : Takashi SAITO, ET AL.

It is certified that error appears in the above-identified patent and that said Letters Patent is hereby corrected as shown below:

Sheet 8 of 9

In Fig. 13, "ANP" should read "AND".

COLUMN 2,

Line 9, "ussage" should read --usage--.

COLUMN 5:

Line 20, "an" should read --a--.

COLUMN 12:

Line 48, "hOme" should read --home--.

COLUMN 13:

Line 5, "cf" should read --of--;
Line 9, "ink cassettes" should read --ink cassette--;
Line 11, "ink cassette" should read --ink cassettes--;
Line 13, "cassettes, cassette" should read --ink cassettes,--; and
Line 37, "ber" should read --ber to be made--.

COLUMN 14:

Line 14, "judge" should read --judged that--; and
Line 31, "that" should read --when--.

UNITED STATES PATENT AND TRADEMARK OFFICE

CERTIFICATE OF CORRECTION

PATENT NO. :4,970,533

DATED :November 13, 1990

INVENTOR(S) :Takashi SAITO, ET AL.

It is certified that error appears in the above-identified patent and that said Letters Patent is hereby corrected as shown below:

COLUMN 15:

Line 13, "used" should read --used.--; and
Line 27, "ink cassette," should read --ink cassettes,--.

COLUMN 16:

Line 50, "I claim:" should read --We claim:--.

COLUMN 17:

Line 15, "said" should read --the--;
Line 57, "the" should read --a--.

COLUMN 19:

Line 20, "ink cassettes" should read --ink cartridges--.

UNITED STATES PATENT AND TRADEMARK OFFICE

CERTIFICATE OF CORRECTION

PATENT NO. : 4,970,533

DATED : November 13, 1990

INVENTOR(S) : Takashi Saito, et al

It is certified that error appears in the above-identified patent and that said Letters Patent is hereby corrected as shown below:

COLUMN 20:

Line 2, "on" should read --on said--; and
Line 6, "at least one said" should read --said at least one--.

Signed and Sealed this

Eleventh Day of August, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,970,533

DATED : November 13, 1990

INVENTOR(S) : Takashi Saito, et al

It is certified that error appears in the above-identified patent and that said Letters Patent is hereby corrected as shown below:

On the title page;

[30] Foreign Application Priority Data:

Insert --Oct. 25, 1989 [JP] Japan.....1-278270--.

COLUMN 15:

Line 13, "used" should read --used.--; and
Line 27, "ink cassette," should read --ink cassettes,--.

COLUMN 16:

Line 50, "I claim:" should read --We claim:--.

UNITED STATES PATENT AND TRADEMARK OFFICE

CERTIFICATE OF CORRECTION

PATENT NO. : 4,970,533

DATED : November 13, 1990

INVENTOR(S) : Takashi Saito, et al

It is certified that error appears in the above-identified patent and that said Letters Patent is hereby corrected as shown below:

COLUMN 17:

Line 15, "said" should read --the--;
Line 57, "the" should read --a--.

COLUMN 19:

Line 20, "ink cassettes" should read --ink cartridges--.

Signed and Sealed this

Eighth Day of September, 1992

*Attest:*

*Attesting Officer*

DOUGLAS B. COMER

*Acting Commissioner of Patents and Trademarks*